United States Patent [19]

Nishiwaki

[11] 4,079,682

[45] Mar. 21, 1978

[54] APPARATUS FOR FORMING TUCKS IN A CURTAIN CLOTH OR THE LIKE

[75] Inventor: Fukujiro Nishiwaki, Maebashi, Japan

[73] Assignee: C. Kondo & Co., Ltd., Kobe, Japan

[21] Appl. No.: 789,795

[22] Filed: Apr. 22, 1977

[30] Foreign Application Priority Data

May 21, 1976 Japan ..... 51-57926

[51] Int. Cl.[2] ..... D05B 35/08

[52] U.S. Cl. ..... 112/134; 112/144; 112/155; 223/30

[58] Field of Search ..... 112/132, 134, 135, 144, 112/145, 155; 223/30, 34, 28

[56] References Cited

U.S. PATENT DOCUMENTS

| | | | |
|---|---|---|---|
| 411,917 | 10/1889 | Faulkner | 112/155 X |
| 3,802,361 | 4/1974 | Block | 112/144 X |
| 3,805,718 | 4/1974 | Levinstein | 112/134 |
| 3,824,964 | 7/1974 | Ryan | 223/30 |

*Primary Examiner*—Werner H. Schroeder
*Assistant Examiner*—Peter Nerbun
*Attorney, Agent, or Firm*—Posnack, Roberts & Cohen

[57] ABSTRACT

An apparatus for forming triple type of tucks in a curtain cloth is disclosed. The apparatus comprises on a base frame a first sewing machine with a first presser, a second sewing machine with a second presser, a movable base plate arranged for movement in the transverse direction of the cloth, and a stationary base plate arranged adjacent the second sewing machine. Further, a pair of upper and lower keep plates, a pair of upper and lower expansion spatulas, and a width setting spatula are mounted on the movable base plate for movement in the lengthwise direction of the cloth, and extend therefrom over a face plate. A double tucking plate with two sheet metals extends from the stationary base plate over the face plate.

A portion of the cloth to be tucked is applied with its center line to an edge of the width setting spatula and the cloth is folded back with its upper and lower portions around the spatula and then passed outside the upper and lower expansion spatulas and between the upper and lower keep plates. While the upper and lower pressers with the cloth held there-between are moved transversely of the cloth, the cloth is stitched by the first sewing machine.

Then, the width setting spatula and the upper and lower expansion spatulas are moved with the cloth held thereon lengthwise of the cloth toward the second sewing machine to insert the width setting spatula between the two sheet metals of the double tucking plate and arrange the upper expansion spatula and the lower expansion spatula over the upper sheet metal and under the lower sheet metal of the double tucking plate, respectively, so that triple type of tucks are formed in the cloth. These tucked portions are stitched by the second sewing machine.

8 Claims, 39 Drawing Figures

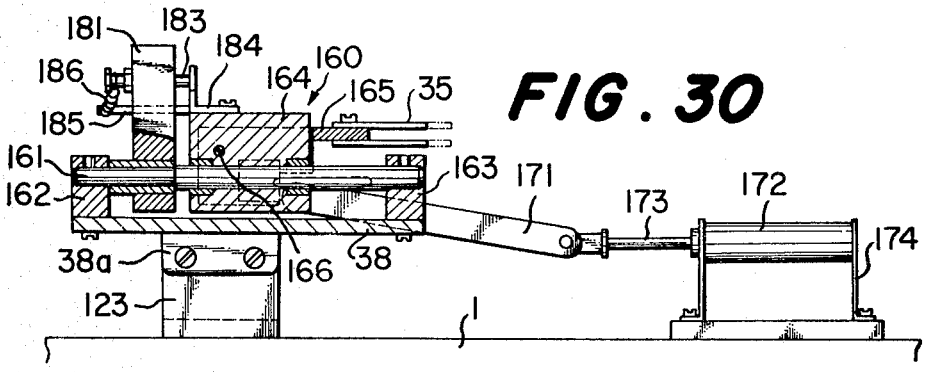
FIG. 30
FIG. 31
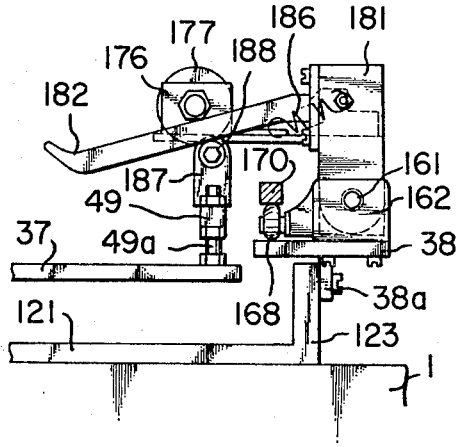
FIG. 32
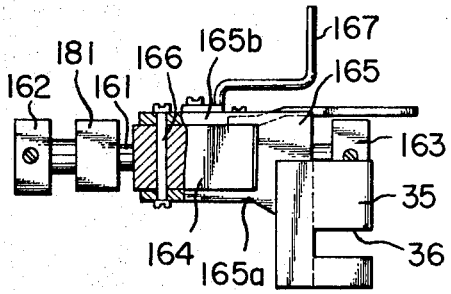
FIG. 33
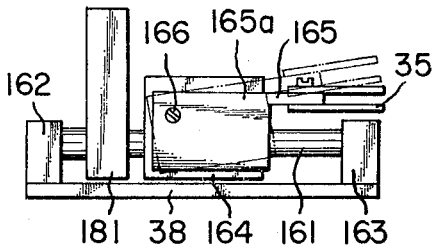

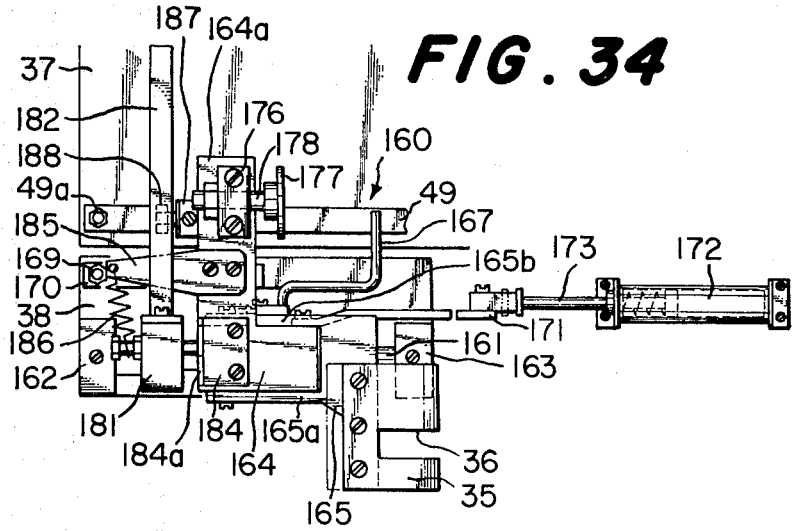
FIG. 34
FIG. 35
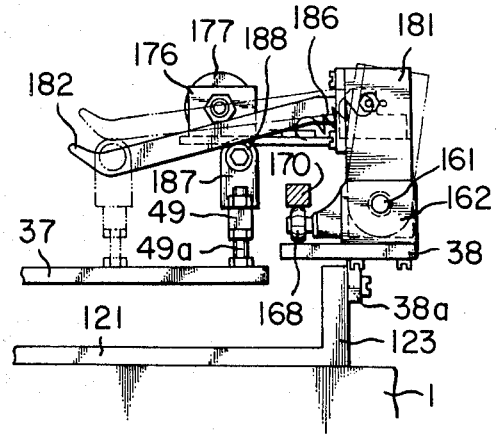

APPARATUS FOR FORMING TUCKS IN A CURTAIN CLOTH OR THE LIKE

BACKGROUND OF THE INVENTION (1) Field of the Invention

This invention relates to an apparatus for forming triple type of tucks in curtains or the like.

(2) Brief Description of the Prior Art

Heretofore, triple type of tucks have been formed in curtains by hand operation and stitched with a sewing machine. However, such hand operation was time-consuming and trouble-some, so the resulting products were expensive. Also, apparatuses for forming double type of tucks in curtains have been developed and put into practice in some area, however, apparatuses for forming triple type of tucks have had no practical application because such apparatuses required complicated movements of a number of tucking members.

A main object of the invention is to eliminate the above-mentioned disadvantage and to provide an apparatus for making quickly and automatically triple type of tucks in a curtain cloth or the like.

Another object of the invention is to provide an apparatus for making continuously and quickly a curtain with tucks having loops for fitting hanger hooks.

BRIEF DESCRIPTION OF DRAWINGS

These and other objects of the invention will be seen by reference to the description, taken in connection with the accompanying drawings, in which:

FIG. 30 is a sectional view taken along the line C—C of the means of FIG. 29;

FIG. 31 is a side view of the means of FIG. 29,

FIG. 32 is a fragmentary plan view of the means of FIG. 29;

FIG. 33 is a side view of a portion in FIG. 32;

FIG. 34 is a plan view of the means of FIG. 29 for explaining the step of retreating somewhat the double tucking plate with respect to the cloth;

FIG. 35 is a side view of the means of FIG. 34;

DESCRIPTION OF THE PREFERRED EMBODIMENT

Figure 1:
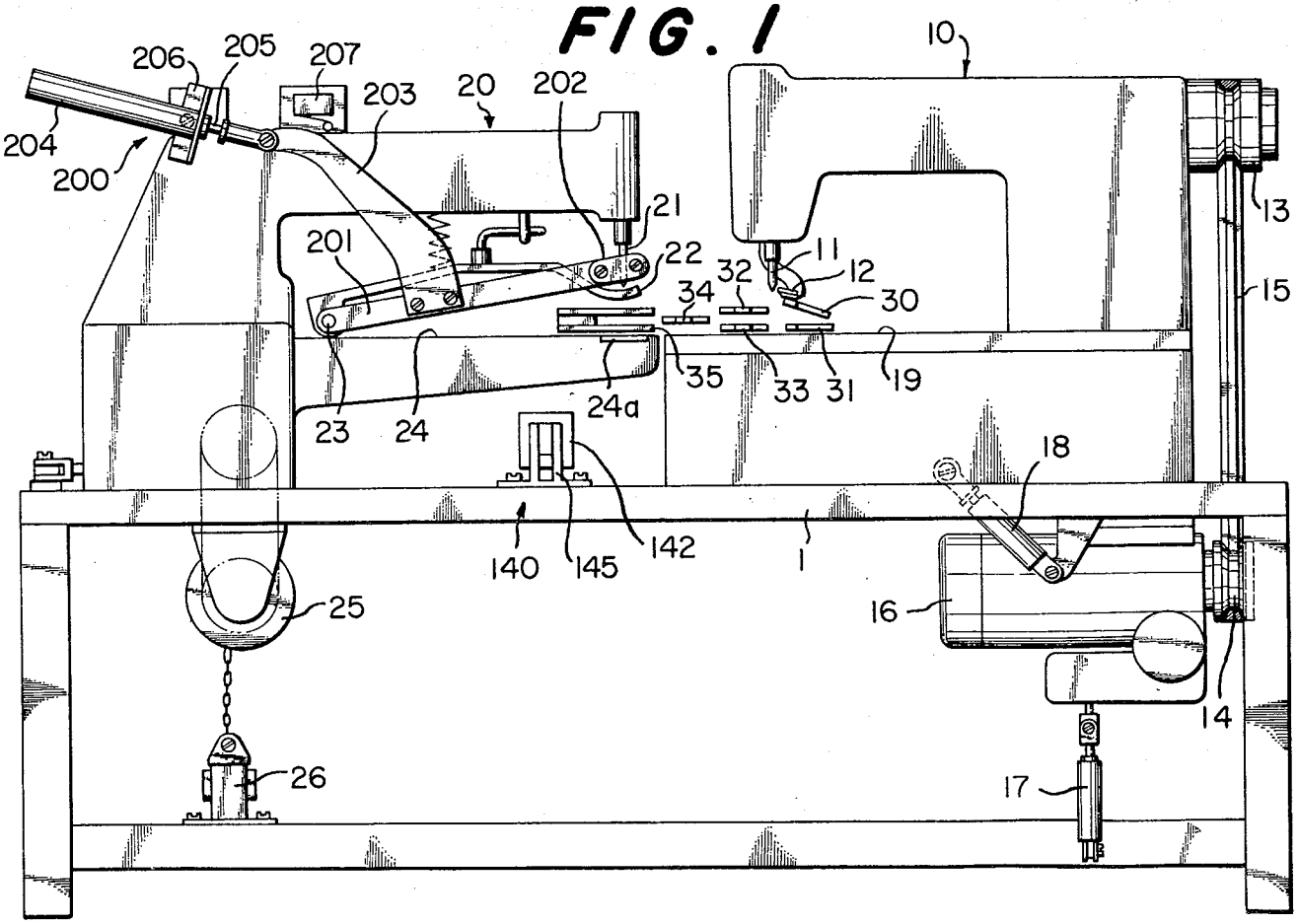
FIG. 1 is a schematic front view of a whole apparatus according to the invention.

Referring to FIG. 1, a first sewing machine 10 which is of a conventional lock stitch type is mounted at the right side on the base frame 1. Reference numeral 11 indicates a needle, 12 a first presser, 13 and 14 pulleys, 15 a V-belt, 16 a motor, 17 a hydraulic or pneumatic piston-cylinder assembly for actuating a motor clutch, 18 a piston-cylinder assembly for moving the first presser upward and downward, and 19 a face plate or working plate. Provided at the left side of the base frame 1 in opposite relation to the first sewing machine 10 is a second sewing machine. Reference numeral 24 indicates a face plate or working table, **24*a* a support plate which is mounted for oscillating movement with a second presser in the transverse direction of a cloth to be tucked, 25 a motor, and 26 a solenoid for actuation of the motor 25**.

Figure 3:
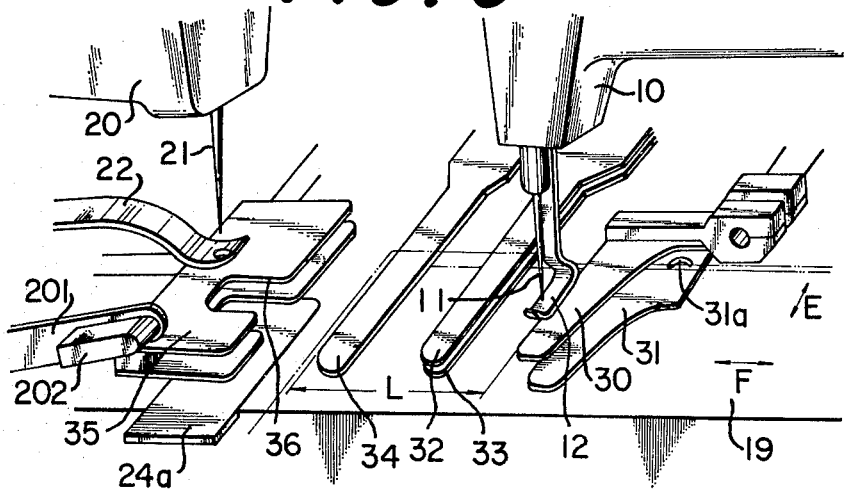
FIG. 3 is a perspective view of each member for forming tucks and arranged over a face plate between sewing machines.
Figure 4:
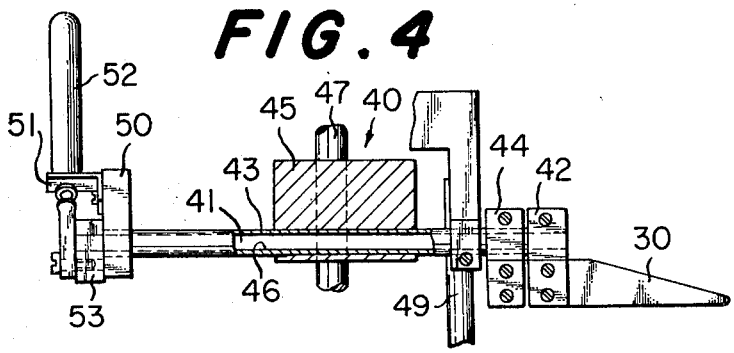
FIG. 4 is a plan view of a means for moving an upper keep plate upward and downward with respect to a lower keep plate.
Figure 5:
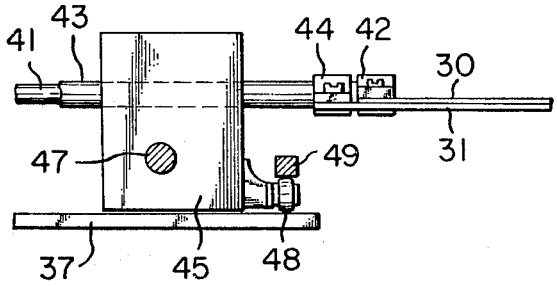
FIG. 5 is a fragmentary side view of the means of FIG. 4.
Figure 6:
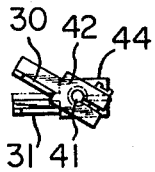
FIG. 6 is an end view of the upper and lower keep plates in the means of FIG. 4 as viewed from the front thereof.
Figure 7:
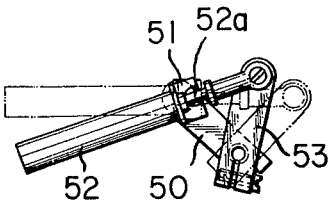
FIG. 7 is an end view of the means of FIG. 4 as viewed from the rear thereof.

Arranged over the face plate between these sewing machines in spaced relation from one another are members which perform the tucking operation. As best seen from FIG. 3, upper and lower keep plates 30, 31 for holding the cloth therebetween extend from the rear across the cloth on the face plate 19 and in adjacent relation to the needle 11 under the first presser 12 of the sewing machine 10. Further, upper and lower expansion spatulas 32, 33 arranged one above the other in spaced relation from each other extend in parallelspaced relation to the upper and lower keep plates 30, 31, and a width setting spatula 34 extends in parallel-spaced relation to the expansion spatulas 32, 33. Since a portion of the cloth to be tucked is applied with its center line to the longitudinal side edge of the width setting spatula 34 and then the cloth is folded back with its upper and lower portion around the spatula as shown with an imaginary line, the height of triple type of tucks may be determined depending on a position of the width setting spatula 34. In FIG. 3, arrow marks E and F indicate the transverse and lengthwise directions of the cloth to be tucked, respectively. Further a double tucking plate 35 having upper and lower sheet metals is arranged adjacent the width setting spatula 34 under the needle 21 of the second sewing machine 20. The double tucking plate is provided with notches 36 so that the second presser 22 of the second sewing machine 20 may be oscillated in the transverse direction of the cloth while holding the cloth between the support plate 24*a* and the second presser 22. In this connection, reference numeral 31*a* indicates a stopper which is provided on the lower keep plate 31 and serves to position the cloth to be tucked in the transverse direction thereof.

A plurality of means for operating several members which perform the tucking operation and which are arranged in parallel-spaced relation over the face plate will be explained below. It is to be noted that various means for operating the upper and lower keep plates 30, 31, the upper and lower expansion spatulas 32, 33 and the width setting spatula 34 are mounted on a movable base plate 37, while a means for operating the double tucking plate 35 is mounted on a stationary base plate 38.

First, a means 40 for moving the upper keep plate 30 up and down to bring it into and out of engagement with the lower keep plate 31 will be explained with reference to FIG. 4, 5, 6 and 7. The upper keep plate 30 is firmly mounted on an arm 42 fixedly secured to the front end of an elongated shaft 41. A tube 43 is rotatably mounted on the shaft 41 and the lower keep plate 31 is mounted on an arm 44 fixedly secured to the front end of the tube 43. The tube 43 is supported for sliding movement within a bore 46 of a block 45 which can be slid lengthwise of the cloth to be tucked on a stationary shaft 47 supported on the movable base plate 37. A roller 48 is attached to the front surface of the block 45 and guided for rolling engagement between a stationary rail 49 and the movable base plate 37. A lever 50 is firmly mounted on the rear end of the tube 43 so as to extend obliquely upwardly and a piston-cylinder assembly 52 is pivotally mounted on a free end of the lever 50 through a bracket 51. Further, a lever 53 is firmly mounted on the rear end of the shaft 41 within the tube 43, making an angle with the lever 50 and the end of a piston rod 52*a* of the piston-cylinder assembly 52 is pivotally connected to a free end of the lever 53. Accordingly, upon actuation of the piston-cylinder assembly 52, the lever 53 is pivotally moved relative to the stationary lever 50, so that the shaft 41 is rotated within the tube 43 and the upper keep plate 30 is moved downward to hold the cloth between the upper and lower keep plates.

Figure 8:
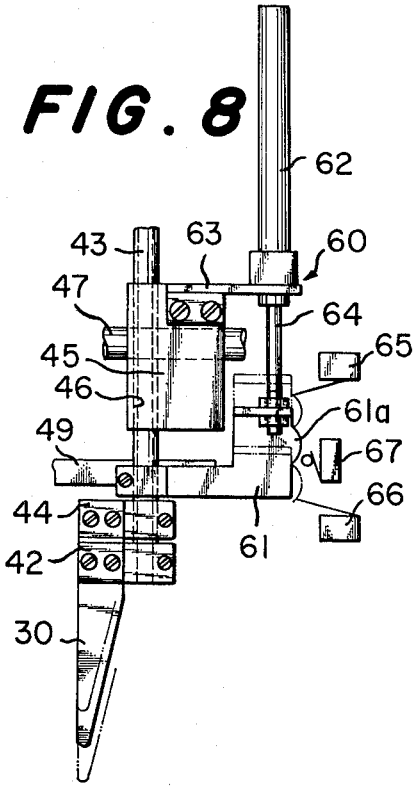
FIG. 8 is a plan view of a means for reciprocating the upper and lower keep plates forward and backward.
Figure 9:
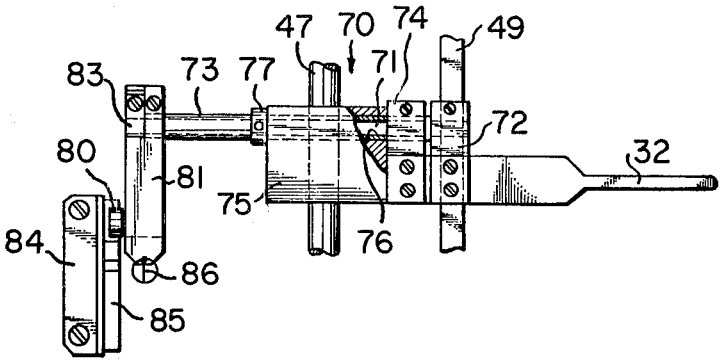
FIG. 9 is a plan view of a means for moving up and down upper and lower expansion spatulas toward and away from each other.
Figure 10:
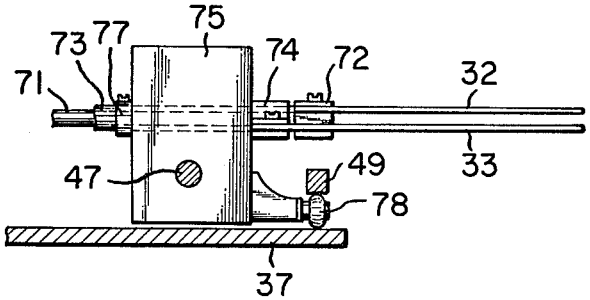
FIG. 10 is a fragmentary side view of a means of FIG. 9.
Figure 11:
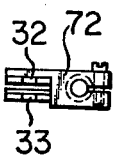
FIG. 11 is an end view of the upper and lower expansion spatulas in the means of FIG. 10 as viewed from the front thereof.
Figure 12:
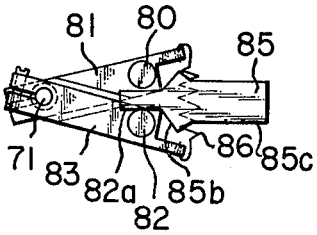
FIG. 12 is an end view of the means of FIG. 9 as viewed from the rear thereof.

Next, a means 60 for reciprocating the upper and lower keep plates 30, 31 forward and backward in the transverse direction of the cloth will be explained with reference to FIG. 8. An L-shaped plate 61 is firmly mounted on the tube 43 in adjacent relation to the arm 44 of the lower keep plate 31. A piston-cylinder assembly 62 is mounted on a bracket 63 fixedly secured to the block 45 and the end of a piston rod 64 of the piston-cylinder assembly 62 is secured to the L-shaped plate 61. Accordingly, operation of the piston-cylinder assembly 62 causes the tube 43 to be slid in the bore 46 of the block 45 for reciprocating movement of the upper and lower keep plates 30, 31. In this connection, reference numerals 65, 66 indicate limit switches which limit the stroke of the keep plates, and 67 a limit switch for stop of the keep plates.

Figure 13:
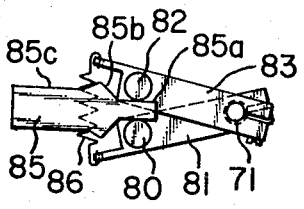
FIG. 13 to FIG. 15 are views for explaining a series of operations of a cam mechanism in the means of FIG. 9.
Figure 14:
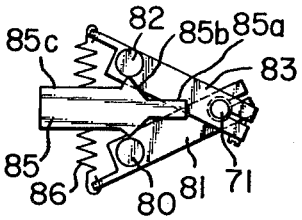
Figure 16:
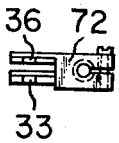
FIGS. 16 to 18 are viwws showing the opening degrees of the upper and lower expansion spatulas corresponding to FIGS. 13 to 15.
Figure 17:
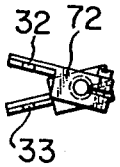
Figure 18:
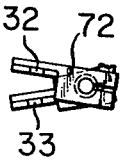

Further, a means 70 for moving vertically the upper and lower expansion spatulas 32, 33 toward and away from each other will be described with reference to FIGS. 9, 10, 11 and 12. The upper expansion spatula 32 is fixedly secured to an arm 72 firmly mounted on the front end of a shaft 71. A tube 73 is rotatably mounted on the shaft 71 and the lower expansion spatula 33 is secured to an arm 74 firmly mounted on the front end of the tube 73. The tube 73 is rotatably fitted in a bore 76 of a block 75 in the same way as in the keep plates and prevented from axially moving with the arm 74 and a collar 77. The block 75 is slidably mounted on the stationary shaft 47 and the roller 78 is attached to the front of the block 75 and guided for rolling engagement between the rail 79 and the movable base plate 37. One roller support arm 81 which rotatably supports a roller 80 is firmly mounted on the rear end of the tube 73, and the other roller support arm 83 which rotatably supports a roller 82 is firmly mounted on the rear end of the shaft 71. These rollers 80 and 82 are biased by means of a spring 86 such that are normally pressed against a cam 85 supported by a bracket 84 on the movable base plate 37. Therefore, when the block 75 is slid on the stationary shaft 47 downward as viewed in FIG. 9, the rollers 82 and 80 are moved from a position on cam surfaces 85*c* (FIGS. 13 and 16) to raised cam surfaces 85*b*, so that the upper and lower expansion spatulas 32 and 33 are vertically pivotally moved away from each other. Further, as the rollers 82 and 80 are moved to cam surfaces 85*c* (FIG. 15), the upper and lower expansion spatulas are pivotably moved toward each other to a position (FIG. 18) where they are expanded less than in the second position of FIG. 17.

Figure 19:
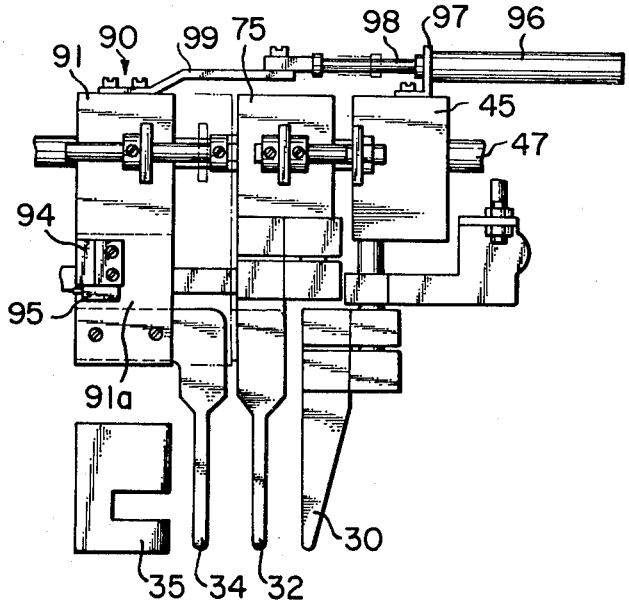
FIG. 19 is a plan view showing together with other components a means for moving a width setting spatula relative to the upper and lower expansion spatulas.
Figure 20:
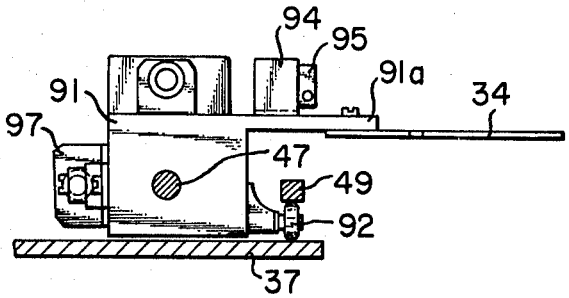
FIG. 20 is a side view of the means of FIG. 19.
Figure 21:
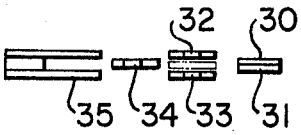
FIG. 21 is a view for explaining a state where the width setting spatula is inserted between the upper and lower expansion spatulas by the means in FIG. 19.

A means 90 for moving the width setting spatula 34 relative to the upper and lower expansion spatulas 32, 33 in the lengthwise direction of the cloth to be tucked will be explained with reference to FIGS. 19, 20 and 21. A block 91 is slidably mounted on the stationary shaft 47 supported on the movable base plate 37 in parallel relation to the lengthwise direction of the cloth, and the block 91 is provided at the front with a roller 92 which is guided for rolling engagement between the rail 49 and the movable base plate 37. The width setting spatula 34 is firmly attached to the front end of an elongated arm 91*a* of the block 91, and further a stopper 94 and a limit switch 95 which perform the function as will be described later are secured to the arm 91*a*. A piston-cylinder assembly 96 is firmly mounted on the block 45 through a bracket 97, and the front end of a piston rod 98 of the piston-cylinder assembly 96 is connected to a rod 99 which is fastened to the block 91 with screws.

Further, a means 100 for moving together the upper and lower keep plates 30, 31, the upper and lower expansion spatulas 32, 33 and the width setting spatula 34 in the lengthwise direction of the cloth will be explained with reference to FIGS. 22 and 23.

The stationary shaft 47 is supported by supports 102 and 103 on the movable base plate 37, and the blocks 45, 75, 91 are slidably mounted on the shaft 47 as stated above, the blocks 45 and 75 are kept in spaced relation from each other by connecting the respective projections 45*a* and 75*a* through a bar 104. Further, a projection 91*a* of the block 91 is slidably fitted on a bar 105 which is at one end screwed in the block 75, and therefore the block 91 can be independently moved with respect to the block 75 by means of the piston-cylinder assembly 96 (FIG. 19). Reference numeral 106 indicates a positioning collar fastened on the bar 105 with a screw.

The rear end of a piston-cylinder assembly 107 is pivotally connected to a support 102 and the end of a piston rod 108 of the piston-cylinder assembly 107 is pivotally connected to a bracket 109 firmly attached to the block 45. An elongated plate 112 is mounted on plates 110, 111 extending upwardly from supports 102, 103 at either sides. A plurality of limit switches 113, 114, 115, 116 are attached to the plate 112 and are adapted to be engaged by dogs 109*a*, 109*b* as the block 45 is moved by actuation of the piston-cylinder assembly 107. Thus, actuation of the piston-cylinder assembly 107 causes the blocks 45 and 75 to be moved as one piece, however, if a chamber in the cylinder of the piston-cylinder assembly 96 at the opposite side to the piston rod is filled with fluid under pressure, three blocks can be moved as one piece with the space kept between the blocks 91 and 75.

Figure 24:
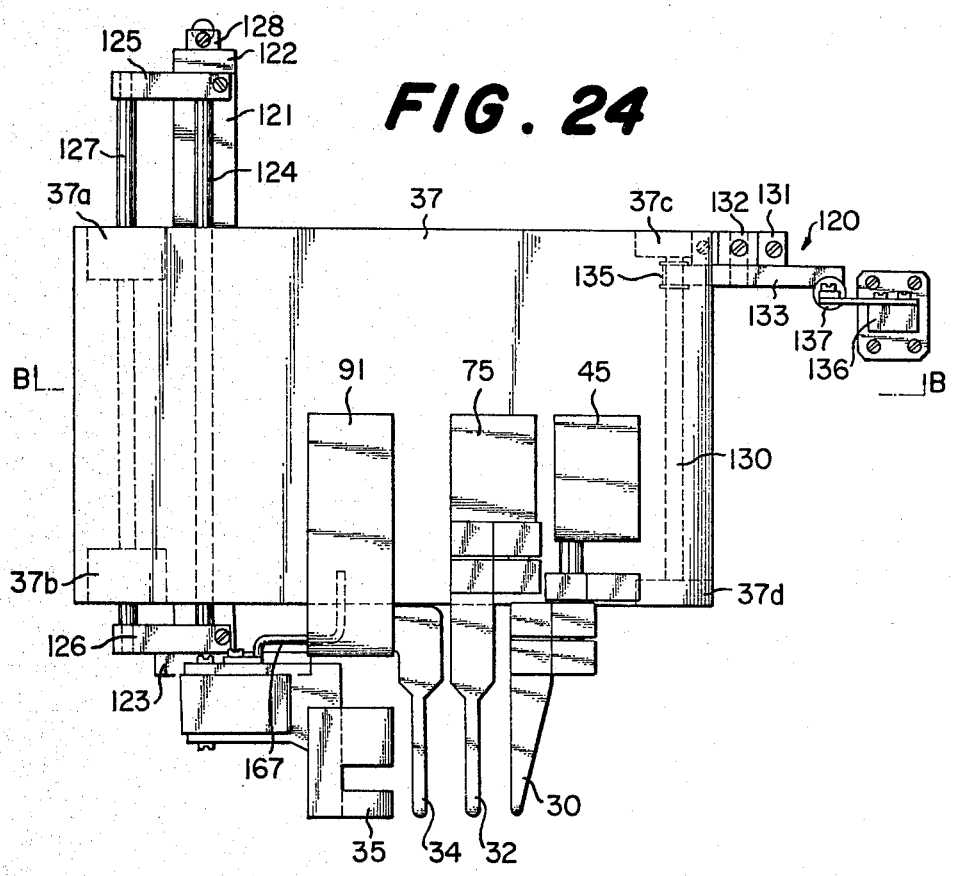
FIG. 24 is a plan view of a means for lifting a movable base plate on which the upper and lower keep plates, the upper and lower expansion spatulas and the width setting spatula are mounted.
Figure 25:
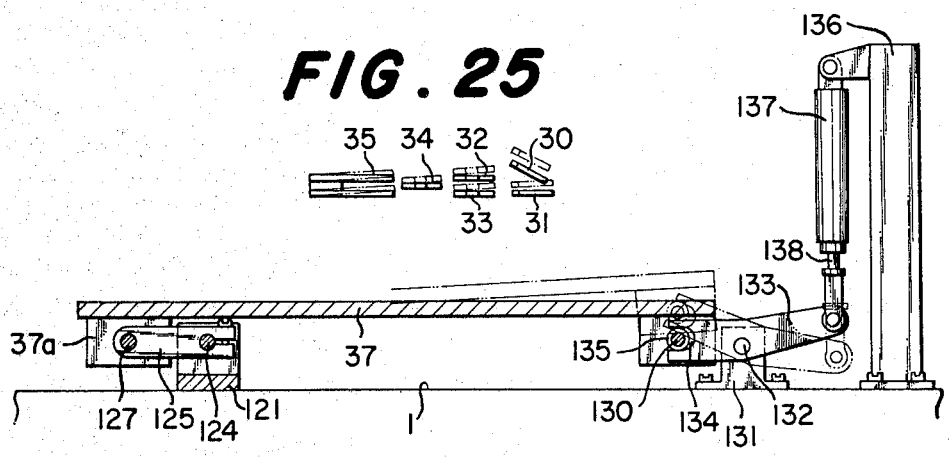
FIG. 25 is a sectional view taken along the line B—B of FIG. 24.
Figure 26:
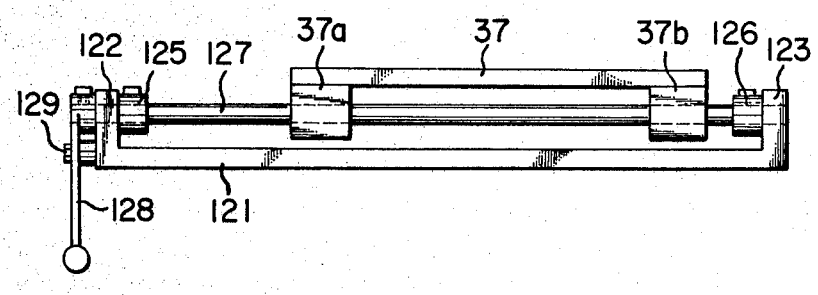
FIG. 26 is a side view of the means of FIG. 24.

Now, it is preferable to somewhat lift the movable base plate 37 so as not to cause any inadvertent contact with the face table 19 when the upper and lower expansion spatulas are moved upwardly and downwardly in the direction away from each other, respectively. For this purpose, a movable base plate lifting means 120 is provided which will be explained below with reference to FIGS. 24, 25 and 26. An elongated support 121 is firmly mounted on the base frame 1 so as to extend in the transverse direction of the cloth, and a long adjusting shaft 124 is supported by bearings 122, 123 at both sides of the support 121. Adjusting arms 125, 126 are fastened to the adjusting shaft 124 adjacent the bearings 122, 123 so as to extend outwardly and these adjusting arms carry a pivotal shaft 127. A handle 128 is firmly mounted on the rear end of the adjusting shaft 124, and rotation of the handle 128 causes the adjusting arms 125, 126 to be pivotally moved about the shaft 124 so that the height of the pivotal shaft 127 can be varied. After such adjustment, the handle 128 may be fastened to the support 121 with a bolt 129.

The movable base plate 37 is supported at one side for sliding movement on the pivotal shaft 127 through bosses 37*a*, 37*b* projecting downwardly therefrom and at the opposite side firmly carries a shaft 130 through bosses 37*c*, 37*d* projecting downwardly from the movable base plate 37. On one hand, a support 131 is firmly mounted on the base frame 1 and a swing lever 133 is pivotally mounted on a shaft 132 projecting from the support 131. The swing lever 133 is formed at one end with a notch 134 in which the shaft 130 of the movable base plate 37 is supported through a bush 135. The end of a piston rod 138 of a piston-cylinder assembly 137 suspended from a support 136 is pivotally connected to the other end of the swing lever 133. As seen from the above-mentioned explanation, actuation of the piston-cylinder assembly 137 causes the movable base plate 37 to be pivotally moved about the pivotal shaft 127, whereby it can be lifted or lowered.

In order to move backward and forward the upper and lower keep plates 30, 31, the upper and lower expansion spatulas 32, 33 and the width setting spatula 34 in the transverse direction of the cloth to be tucked, it is necessary to move backward and forward the movable base plate 37 to which such tucking members are attached. A means 140 for moving the movable base plate 37 backward and forward will be explained with reference to FIGS. 27 and 28.

An L-shaped bracket 141 is secured to the under surface of the forward end portion of the movable base plate 37, and the piston rod 143 of a piston-cylinder assembly 142 is pivotally connected to the bracket 141. The piston-cylinder assembly 142 is firmly mounted at the piston rod side on the base frame 1 through a flange 144 and is pivotally connected at the opposite end to a support 145 on the base frame 1. Reference numerals 146, 147, 148 indicate limit switches, 149 a dog plate which is positioned so as to be engaged by the limit switch 146, 150 a dog plate which is arranged so as to be engaged by the limit switches 147 and 148.

Figure 29:
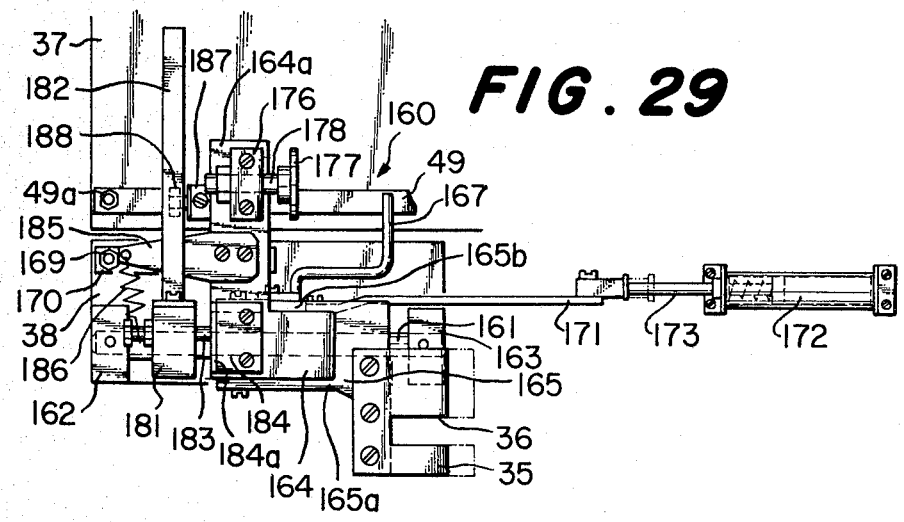
FIG. 29 is a plan view of a means for moving a double tucking plate in the lengthwise direction of the cloth.
Figure 36:
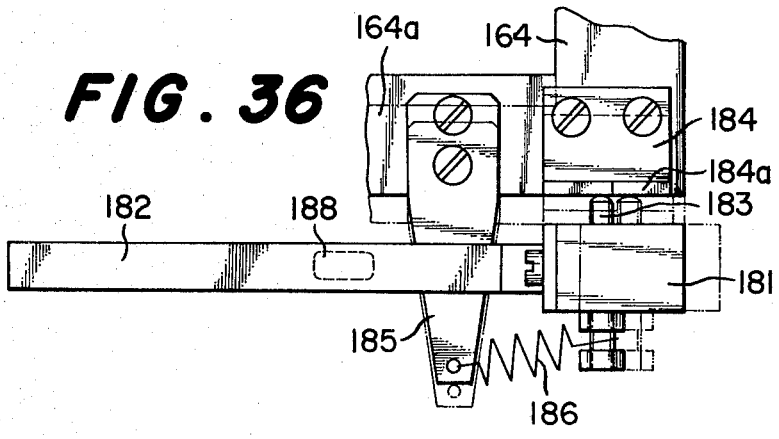
FIG. 36 is a fragmentary enlarged plan view of the means of FIG. 34.

As mentioned before, the stationary base plate 38 provided separately from the movable base plate 37 is provided with an operating means 160 for the double tucking plate 35 which will be explained mainly with reference to FIGS. 29, 30 and 31.

The stationary base plate 38 is fixedly secured to the bearing portion 123 of the support 121 through the downwardly projecting portion 38*a*. Supports 162 and 163 supporting a shaft 161 is firmly mounted on the stationary base plate 38 at either longitudinal ends thereof. A block 164 is slidably mounted on the shaft 161. As best seen from FIGS. 32 and 33, a movable arm 165 having forked side plates 165*a* and 165*b* is connected for upward and downward pivotal movement to the block 164 through a pivotal shaft 166. The above-mentioned double tucking plate 35 is formed by securing sheet metals with notched portions to the face and the reverse face at the free end of the movable arm 165. A L-shaped rod 167 is secured to the side plate 165*b*, and as seen in FIG. 29, the free end of the rod 167 bears on the rail 49 supported on the movable base plate 37 in parallel-spaced relation thereto with threaded rods 49*a* and nuts 49*b*. Accordingly, when the movable base plate 37 has been lifted by the piston-cylinder assembly 137, the double tucking plate 35 is lifted together through the L-shaped rod 167 and pivotally moved about the pivotal shaft 166. As best seen from FIG. 31, a roller 168 is attached to the lower portion of the block 164 and is guided for rolling movement between the stationary base plate 38 and a rail 170 kept on the stationary base plate in parallel-spaced relation thereto through threaded rods 169.

A connecting rod 171 is pivotally connected at one end to the lower portion of the block 164 and at the other end to a piston rod 173 of a piston-cylinder asembly 172 which is firmly mounted on the base frame 1 through flanges 174. Referring to FIG. 29, a strip-plate 164*a* extends backward from the upper end of the block 164 and has a support piece 176 secured to the end thereof. A threaded shaft 178 having a disc 177 at one end is threadably connected to the support piece 176. The disc 177 is adapted to be engaged by the stopper 94 of the block 91 supported slidably on the movable base plate 37 to operate the limit switch 95 during tucking operation.

In stiching with the second sewing machine 20 the triple type of tucks formed on the double tucking plate 35 through tucking operation, it is preferable to somewhat retreat the double tucking plate 35 from the tucked cloth for easy movement of the same, because the stitching operation is effected oscillating the cloth in the transverse direction thereof with the cloth held between the second presser 22 and the support plate 24*a* (FIG. 1). A means 180 for retreating the double tucking plate 35 from the cloth will be explained with reference to FIGS. 34, 35, 36 and 37.

A movable arm 181 is pivotally mounted on the shaft 161 in adjacent relation to the block 164 and has an elongated lever 182 extending backward from the upper end of the arm 181. A bolt 183 is screwed through the upper portion of the movable arm 181, and the point of the bolt is normally in contact with a stopper 184 secured to the upper surface of the block 164. The stopper 184 is formed with a notch 184*a* adjacent the point of the bolt 183. On one hand, a spring mounting plate 185 projects from the strip plate 164*a* of the block 164, and a tension spring 186 is anchored at one end to the end of the spring mounting plate 185 and at the other end to the head of the bolt 183 screwed in the movable arm 181. Accordingly, the lever 182 is normally biased downward by means of the spring 186 and is normally in abutting engagement with a roller 188 mounted on the rail 49 through a support bracket 187 when the movable base plate 37 in its advanced position with each tucking member extending over the face plate 19. As best seen from FIG. 35 or FIG. 37, when the roller 188 comes to the position shown with imaginary line during retreat of the movable base plate 37, the lever 182 is raised and the point of the bolt 183 is moved to the position of the notch 184*a*, so that the block 164 which has been pressed by the piston-cylinder assembly 172 is retreated till it strikes the movable arm 181 and stops. Such retreated position of the double tucking plate 35 is shown in FIG. 34 with imaginary line.

Figure 2:
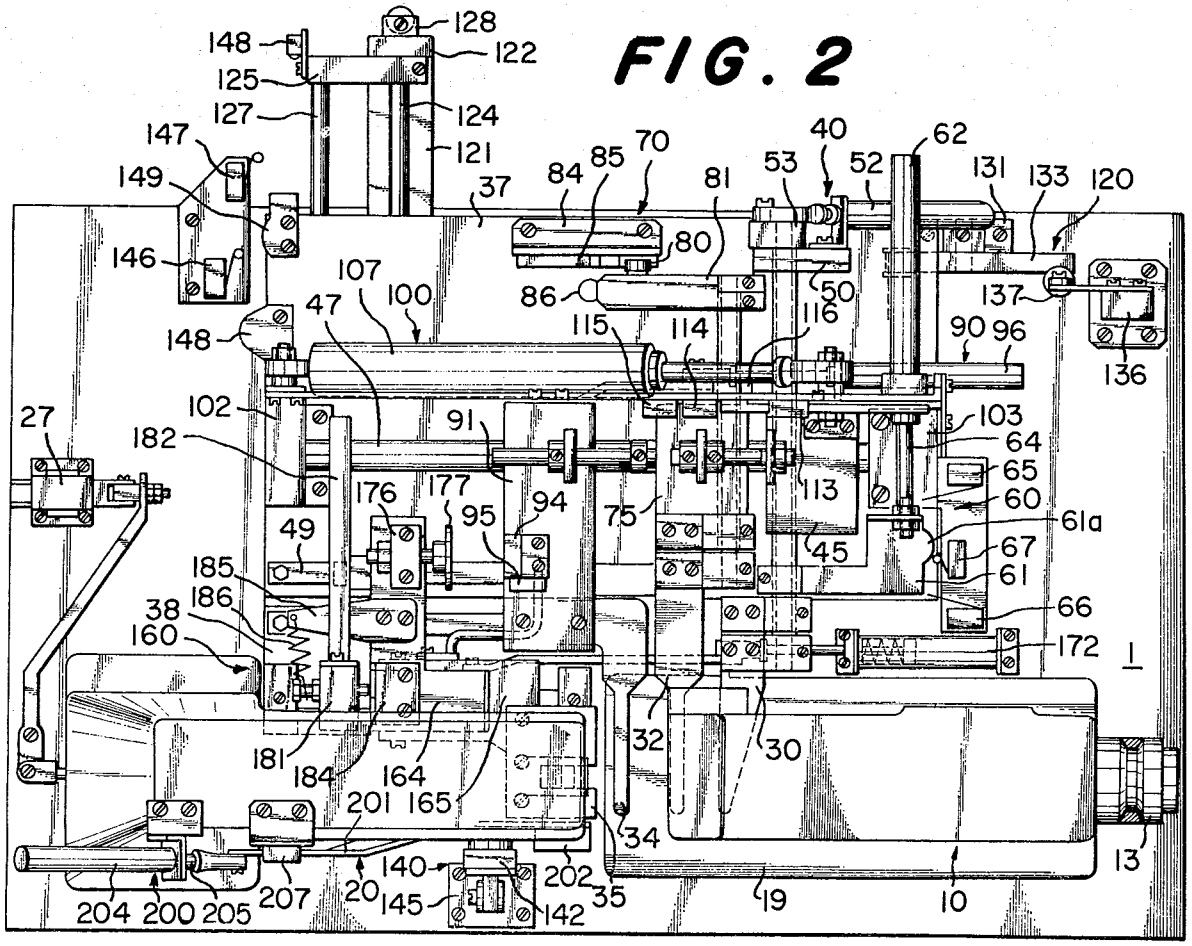
FIG. 2 is a plan view of the apparatus of FIG. 1.

Lastly, after triple type of tucks have been formed in the cloth by the double tucking plate 35, the width setting spatula 34 inserted between two sheet metals of the double tucking plate 35, and the upper and lower expansion spatulas 32 and 33 positioned over the upper sheet metal and under the lower sheet metal of the double tucking plate 35 respectively, it is necessary to retreat the width setting spatula 34, the upper and lower expansion spatulas 32, 33 and the keep plates 30, 31 from the cloth to stitch it with the second sewing machine 20. Then, it is also necessary to hold down the cloth to prevent it from being removed or getting out of shape. A means 200 for holding down the cloth will be explained with reference to FIGS. 1 and 2.

A lever 201 is pivotally connected to a pivotal shaft 23 of the second presser 22 of the second sewing machine 20, and is adapted to hold down the cloth on the support plate 24*a* by a head 202 attached to the end of the lever 201. A curved lever 203 is secured at one end to the middle of the lever 201 and pivotally connected at the other end to a piston rod 205 of a piston-cylinder assembly 204. The piston-cylinder assembly 204 is mounted for pivotal movement on the frame of the second sewing machine 20 through a flange 206. Reference numeral 207 indicates a limit switch which is located to be engaged by the lever 203 during actuation of the piston-cylinder assembly 204.

Figure 28:
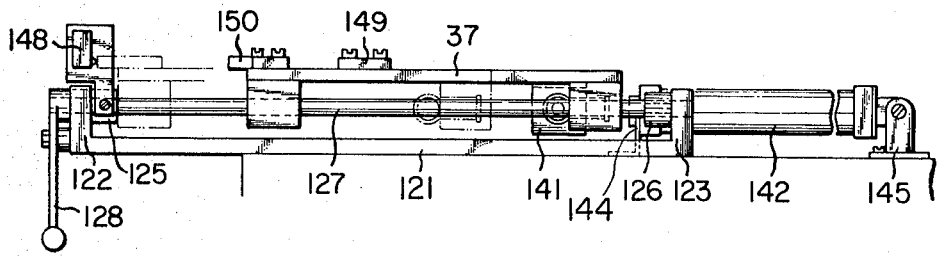
FIG. 28 is a side view of the means of FIG. 27.
Figure 38:
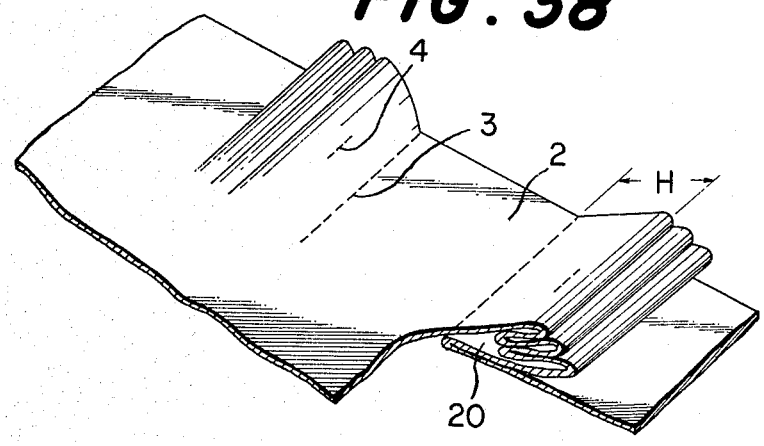
FIG. 38 is a perspective view showing triple type of tucks formed in a curtain or the like by the apparatus according to the invention.
Figure 39:
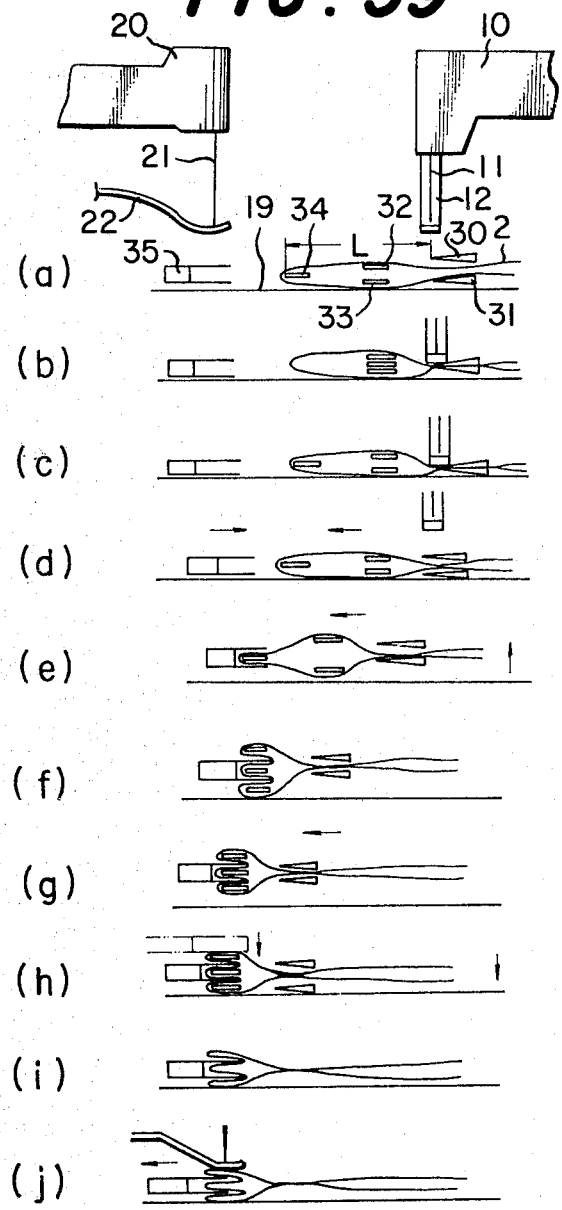
FIG. 39 is a view showing a series of the steps of (a) to (j) through which triple type of tucks are formed in curtains by the operations of the tucking members arranged over the face plate as viewed from the front thereof.

Now, the procedures for forming in the cloth triple type of tucks shown in FIG. 28, by operation of the apparatus of the invention constituted as mentioned above will be described. In FIG. 38, reference numeral 2 indicates a cloth such as curtain cloth, 3 a stitched line sewed with the first sewing machine 10, and 4 a stitched line sewed with the second sewing machine 20. FIG. 39 is a schematic view of each tucking member, as viewed from the front, arranged over the face plate 19 and is a view for explaining a series of movements of each tucking member until triple type of tucks are formed in the cloth.

(a) As shown in FIG. 39(*a*), a portion of the cloth 2 to be tucked is applied with its center line to a longitudinal side edge of the width setting spatula 34, and the cloth is folded back with its upper and lower portions around the width setting spatula 34 toward the first sewing machine 10. Then, the cloth 2 is set such that the upper and lower folded portions of the cloth pass outside the upper and lower expansion spatulas 32, 33 and subsequently pass together between the upper and lower keep plates 30, 31.

(b) Upon turning on a main switch (not shown) of the apparatus, a solenoid control valve (not shown) for the piston-cylinder assembly 52 is changed over to actuate the assembly so that the upper keep plate 30 is lowered onto the lower keep plate 31 (imaginary line of FIG. 7) to hold the cloth therebetween. Simultaneously with completion of such operation, the piston-cylinder assembly 18 (FIG. 1) is actuated to thereby lower the first presser 12 of the first sewing machine 10 and stop on the upper keep plate 30. The electrical signal of stopping of the first presser 12 causes the change-over of a solenoid control valve (not shown) for the piston-cylinder assembly 96, whereby it is actuated to draw the block 91 so that the width setting spatula 34 enters between the upper and lower expansion spatulas 32 and 33 as shown with imaginary line in FIGS. 19, 21. This is effected to make the cloth loose so that it may be easily moved transversely of the cloth in reciprocating motion relation to the face plate 19 during the sewing operation. Then, the electrical signal of stopping of the width setting spatula 34 causes the change-over of a solenoid control valve (not shown) for the piston-cylinder assembly 62 to thereby actuate the same. With actuation of the assembly 62, the upper and lower keep plates 30, 31 start to move in reciprocating motion relative to the face plate 19 with the cloth held therebetween. At the same time, the piston-cylinder assembly 18 is actuated to engage a motor clutch to thereby rotate the motor 16 and operate the first sewing machine 10. Now, the reciprocating motion of the keep plates 30, 31 will be explained with reference to FIG. 8. The piston rod 64 is first retreated from the position shown with full line and the dog 61*a* comes into contact with the limit switch 65. Upon occurence of such contact, a solenoid control valve (not shown) for the piston-cylinder assembly 62 is changed over to advance the piston rod 64. When the dog 61*a* has been brought into contact with the limit switch 65, a timer (not shown) starts to operate and changes over a solenoid control valve (not shown) for the piston-cylinder assembly 62 after an elapse of the predetermined set time so that the piston rod 64 is retreated again. Then, the dog 61*a* again comes into contact with the limit switch 65 to thereby advance the piston rod 64 until it engages the limit switch 66, which then causes the piston rod 64 to be retreated until it engages the limit switch 67 located at the intermediate position and stops. This signal of the limit switch 67 causes a solenoid control valve (not shown) for the piston-cylinder assembly 17 to be changed over to thereby actuate the same and disengage the motor clutch so that the first sewing machine 10 stops. In this way, the stitched line 3 is formed in the cloth as shown in FIG. 38.

(c) The signal of the limit switch 67 also causes a solenoid control valve (not shown) for the piston-cylinder assembly 96 to be changed over to thereby actuate the same so that the width setting spatula 34 is removed from the position between the upper and lower expansion spatulas 32 and 33 to the left in the lengthwise direction of the cloth and returns to the initial position.

(d) On one hand, when the dog 61*a* has come into contact with the limit switch 67, a timer (not shown) starts to operate and after an elapse of the predetermined set time, a solenoid control valve (not shown) for the piston-cylinder assembly 18 is changed over to operate the same to raise the first presser 12, while actuating the piston-cylinder assembly 52 to raise the upper keep plate 30. Also, simultaneously with an elapse of the above-mentioned predetermined set time, a solenoid control valve (not shown) of the piston-cylinder assembly 107 is changed over to actuate the same. Accordingly, the blocks 45, 75, 91 and consequently the upper and lower keep plates 30, 31, the upper and lower expansion spatulas 32, 33 and the width setting spatula 34 which are attached to the respective blocks begin to move together toward the second sewing machine 20 in the lengthwise direction of the cloth (see FIGS. 22 and 23). Referring to FIG. 23, the bracket 109 firmly mounted on the block 45 starts to move to the left and then the dog 109*b* comes into contact with the limit switch 114, causing a solenoid control valve for the piston-cylinder assembly 172 to be deenergized so that as shown with imaginary line in FIG. 29, the double tucking plate 35 is moved toward the first sewing machine 10 in the lengthwise direction of the cloth by means of a spring incorporated in the cylinder at the piston rod side of the piston-cylinder assembly 172.

Figure 22:
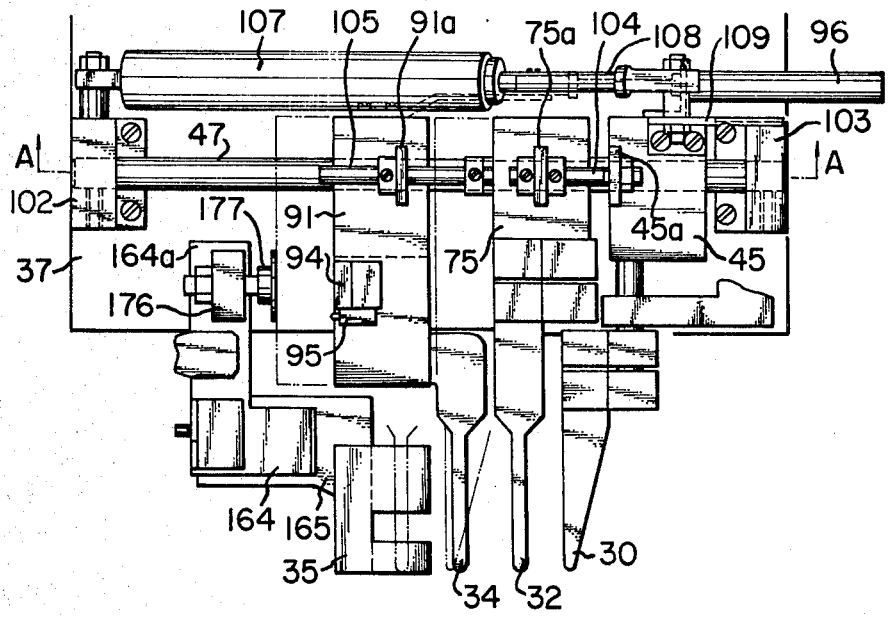
FIG. 22 is a plan view of a means for moving the upper and lower keep plates, the upper and lower expansion spatulas and the width setting spatula together in the lengthwise direction of a cloth.
Figure 23:
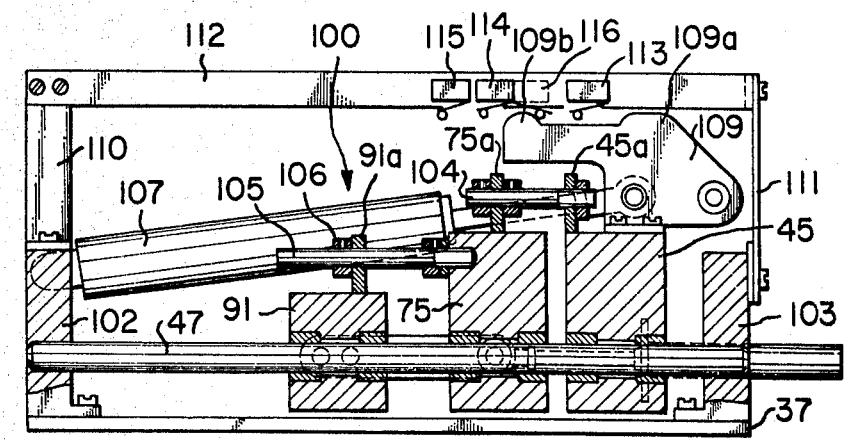
FIG. 23 is a sectional view taken along the line A—A of the means of FIG. 22.

(e) As shown with imaginary line in FIG. 22, the width setting spatula 34 enters between the upper and lower sheet metals of the double tucking plate 35, and the stopper 94 on the block 91 on which the upper and lower expansion spatulas 32, 33 are mounted is brought into contact with the stopper 177 on the extending plate 164*a* of the block 164 to which the double tucking plate 35 is pivotally connected. This causes the limit switch 95 to be operated to thereby change over a solenoid control valve (not shown) for the piston-cylinder assembly 96 so that the fluid under pressure in the cylinder of the assembly 96 at the opposite side of the piston rod is released. Also, the signal of the limit switch 95 causes the fluid under pressure to enter into the cylinder of the piston-cylinder assembly 172 for the double tucking plate 35 at the opposite side of the piston rod.

At the same time, the dog 109*a* of the bracket 109 which is being moved by the piston-cylinder assembly 107 engages the limit switch 113 (FIG. 23) to thereby change over a solenoid control valve (not shown) for the piston-cylinder assembly 137 to actuate the same. This causes the lever 133 to be displaced as shown with imaginary line in FIG. 25 so that the movable base plate 37 is pivotally moved about the pivotal shaft 127 to a position inclined upwardly. At this time, since the L-shaped bar 167 projecting from the movable arm 165 of the double tucking plate 35 is placed on the rail 49 on the movable base plate 37 as shown in FIG. 29, the double tucking plate 35 is also pivotally moved about the pivotal shaft 166 to a position inclined upwardly. This increases the space between the face plate 19 and the lower expansion spatula 33, whereby the upper and lower expansion spatulas 32, 33 can be sufficiently expanded upward and downward, respectively.

On the other hand, since the pressure within the cylinder of the piston-cylinder assembly 96 at the opposite side of the piston rod is released as stated above, the width setting spatula 34 attached to the block 91 is not moved and stays between the upper and lower sheet metals of the double tucking plate 35. Meanwhile, the upper and lower expansion spatulas 32, 33 and the upper and lower keep plates 30, 31 continue to be moved toward the double tucking plate 35 by means of the piston-cylinder assembly 107. During such movement, as shown in FIGS. 13, 14, 16 and 17 the upper and lower cam rollers 82, 80 connected to the upper and lower expansion spatulas 32, 33 respectively are rolled from the cam surfaces 85*a* onto the raised cam surfaces 85*b*, so that the upper and lower expansion spatulas 32 and 33 start to expand upwardly and downwardly, respectively.

(f) Further, when the cam rollers 82, 80 have reached the top of the raised cam surfaces 85*b* of the cam 85, the upper and lower expansion spatulas 32 and 33 are fully expanded and positioned substantially over the upper sheet metal and under the lower sheet metal of the double tucking plate 35 respectively, with the upper and lower portions of the cloth 2 being held backwards by the longitudinal edges of the upper and lower sheet metals of the double tucking plate 35.

Figure 15:
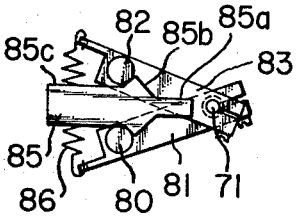

(g) Further, while the subsequent actuation of the piston-cylinder assembly 107 causes the double tucking plate 35, the width setting spatula 34, the upper and lower expansion spatulas 32, 33 to be moved toward the second sewing machine 20 in overlapping and spaced relation, followed by the upper and lower keep plates 30, 31, the rollers 80, 82 connected to the upper and lower expansion spatulas 32, 33 as shown in FIG. 15, reach the cam surfaces 85*c* of the cam 85 so that the upper and lower expansion spatulas 32 and 33 are lowered and raised close to the upper and lower sheet metals of the double tucking plates 35, respectively.

(h) The dog 109*a* of the bracket 109 is moved by means of the piston-cylinder assembly 107 to turn off the limit switch 113. This causes the change-over of a solenoid control valve (not shown) for the piston-cylinder assembly 137 to operate the same, thereby lowering the movable base plate 37 to return each of the tucking members to their normal positions with respect to the face plate 19. Thereafter, the double tucking plate 35, the width setting spatula 34 and the upper and lower expansion spatulas 32, 33 come to stop in position under the second sewing machine 20 and at the same time, the dog 109*b* strikes the limit switch 115 (FIG. 23) to change over a solenoid control valve (not shown) for the piston-cylinder assembly 204, thereby actuating the same (see FIG. 1) to pivotally move the lever 201 down about the pivotal shaft 23 so that the cloth is pressed against the support plate 24*a* through the head 202.

(i) At this time, the lever 203 engages the limit switch 207 to change over a solenoid control valve (not shown) for the piston-cylinder assembly 142, thereby actuating the same to retreat the movable base plate 37, this causes the width setting spatula 34, the upper and lower expansion spatulas 32, 33 and the upper and lower keep plates 30, 31 to be withdrawn from the cloth and retreated from the face plate under the second sewing machine 20. During retreat of the movable base plate 37, the dog 149 strikes the limit switch 146 (FIG. 27) to energize the solenoid 27, whereby the lever mechanism actuates to lower the second presser 22 into the notch 36 of the double tucking plate 35 to thereby hold the cloth between the swingable support plate 24*a* and the second presser 22. At the same time, the lever 201 is lifted.

Figure 37:
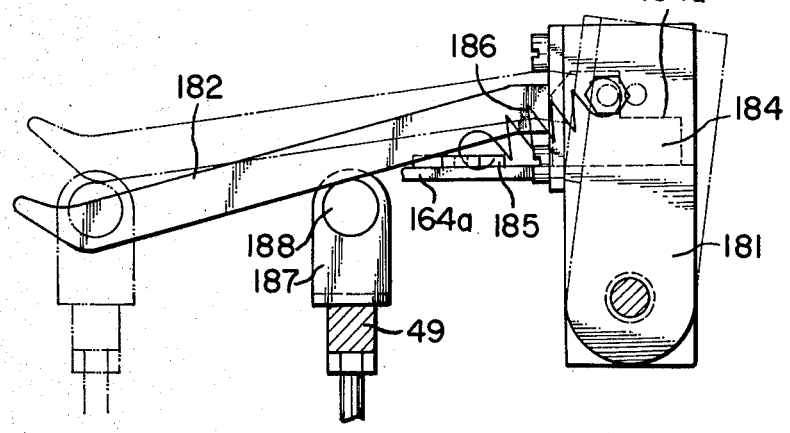
FIG. 37 is a fragmentary enlarged side view of the means of FIG. 35.

(j) While the successive retreat of the movable base plate 37, the roller 188 raises the lever 182 as indicated with imaginary line in FIG. 37 to thereby pivotally move the point of the bolt 183 to a position of the notched portion 184*a*, so that as shown with imaginary line in FIG. 34, the double tucking plate 35 is somewhat retreated from the cloth in the lengthwise direction of the cloth by means of actuation of the piston cylinder assembly 172. This provides sufficient space to the cloth in which tuck are formed, so that it can be easily oscillated together with the second presser 22 in the notched portion of the double tucking plate 35. Subsequently, the limit switch 147 is engaged by the dog 150 of the movable base plate 37 being retreated (FIG. 27) to thereby energize the solenoid 26 to rotate the motor 25, thus operating the second sewing machine (FIG. 1). In this case, the sewing operation is effected while the second presser 22 is oscillated transversely of the cloth with the cloth kept between the second presser 22 and the support plate 24*a*. In this way, as shown in FIG. 38, a stitched line 4 is formed in triple type of tucked portions.

Figure 27:
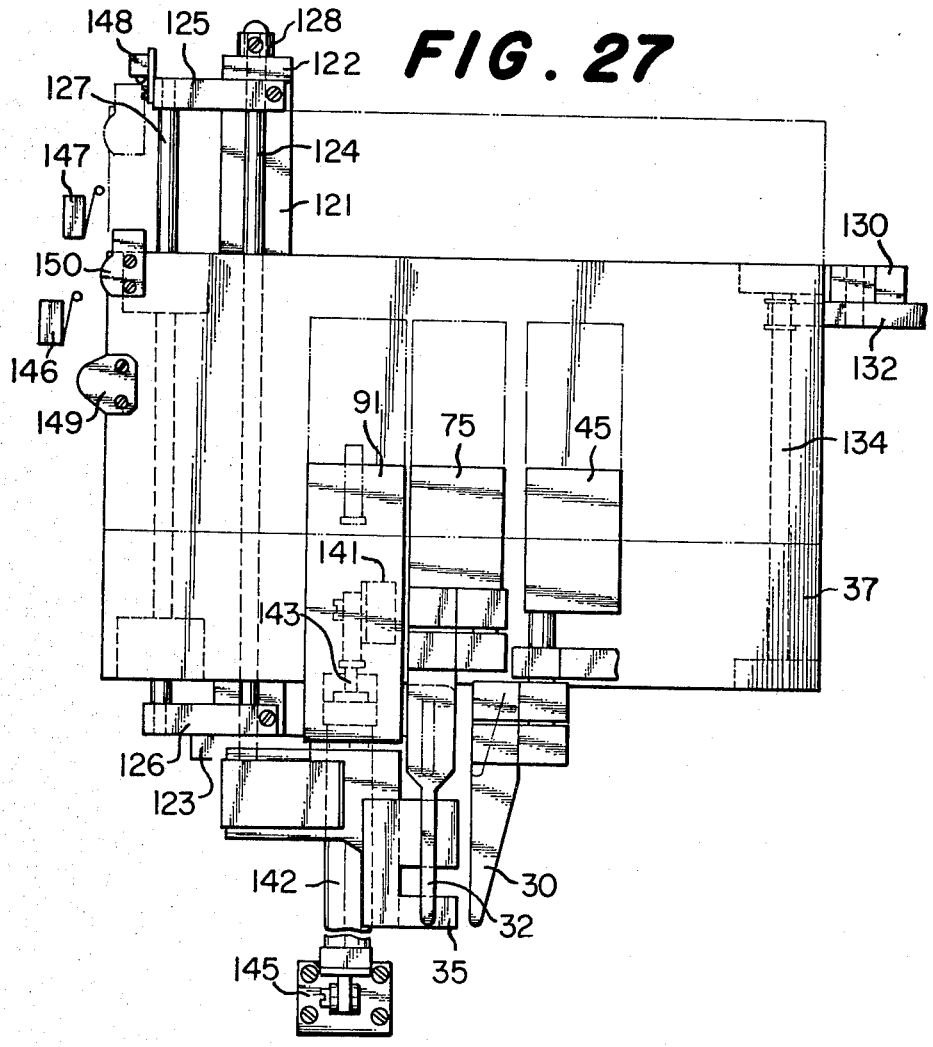
FIG. 27 is a plan view of a means for moving the movable base plate forward and backward in the transverse direction of the cloth.

Meanwhile, when the movable base plate 37 is further retreated by operation of the piston-cylinder assembly 142 and stops, the limit switch 148 is engaged by the dog 150 (FIG. 27). This causes a solenoid control valve (not shown) for the piston-cylinder assembly 107 to be changed over to actuate the same, so that the movable base plate 37 is moved to the right in the lengthwise direction of the cloth and stops. For a period of time up to such stop, each member will operate in the reverse order as that mentioned before. When the movable base plate 37 has stopped, the limit switch 116 is actuated by the dog 109*b* to return electrical control elements to zero or their initial positions, and at the same time the solenoid control valve (not shown) for the piston-cylinder assembly 142 is changed over to actuate the same so that the movable base plate 37 is advanced toward the face plate 19, thus returning the keep plates 30, 31, the upper and lower expansion spatulas 32, 33 and the width setting spatula 34 to their initial positions.

It is added that since any control hydraulic or pneumatic circuit and electrical circuit for effecting the processes of the above-mentioned operation in order can be easily made by those skilled in the art, such circuit diagrams are omitted.

In this way, the apparatus according to the invention permits triple type of tucks to be automatically and extremely rapidly formed in a curtain cloth or the like through a series of processes. Accordingly, considerably higher productivity can be expected and uniform triple type or tucks can be formed as compared with the conventional hand operation.

Further, in FIG. 3, if the distance L from the stitching position along the longitudinal side edge of the upper keep plate 30 to the longitudinal side edge of the width setting spatula 34 is adjusted, it is possible to vary the height H of the tucked portions.

In the embodiment of the present invention, an apparatus for forming triple type of tucks in a curtain cloth or the like is described, but if the width setting spatula 34 is removed and the double tucking plate 35 is composed of one sheet metal in the present apparatus, it is also possible to form double type of tucks in a curtain cloth or the like by such modified apparatus in the similar manner as stated before.

As many apparently widely different embodiments of this invention may be made without departing from the spirit and scope thereof, it is to be understood that the invention is not limited to the specific embodiment thereof except as defined in the appended claims.

What is claimed is:

1. An apparatus for forming tucks in a curtain cloth or the like, said apparatus comprising a base frame; first and second sewing machines arranged on the base frame opposite to each other; a face plate for guiding and supporting the cloth to be tucked and provided between the first and second sewing machines, said first sewing machine and second sewing machine having a first presser and a second presser respectively; a movable base plate arranged on said base frame behind the face plate for forward and backward movement in the transverse direction of the cloth to be tucked on the face plate; upper and lower keep plates arranged one above the other under the first presser of the first sewing machine and adjacent the needle thereof and extending from the movable base plate over the face plate transversely of the cloth to be tucked; upper and lower expansion spatulas arranged adjacent said keep plates in parallel relation thereto and extending in vertically spaced relation from each other; a width setting spatula extending adjacent said expansion spatulas and in parallel relation thereto; said movable base plate having thereon a means for moving the upper keep plate up and down so as to be brought into and out of engagement with the lower keep plate, a means for reciprocating the upper and lower keep plates backward and forward relative to the face plate in the transverse direction of the cloth to be tucked, a means for moving vertically the upper and lower expansion spatulas toward or from away each other, a means for moving the width setting spatula relative to the upper and lower expansion spatulas in the lengthwise direction of the cloth to be tucked, and a means for transfering the upper and lower keep plates, the upper and lower expansion spatulas and the width setting spatula together in the lengthwise direction of the cloth to be tucked; a stationary base plate arranged on the base frame adjacent said second sewing machine; and a double tucking plate having two sheet metals in vertical spaced relation and arranged adjacent the width setting spatula in parallel relation thereto and extending under the second presser from said stationary base plate over the face plate, said stationary base plate having thereon a means for moving the double tucking plate in the lengthwise direction of the cloth to be tucked.

2. An apparatus as set forth in claim 1, wherein said means for moving the upper keep plate up and down so as to be brought into and out of engagement with the lower keep plate is constituted by a tube supported on the movable base plate and having the lower presser secured thereto at the forward end, a shaft loosely fitted in said tube and having the upper keep plate secured thereto over the lower keep plate and projecting from both ends of the tube, said tube and shaft each having an arm firmly mounted thereon at the rear end, and a piston-cylinder assembly pivotally connected at the end of the cylinder to one of said arms and at the end of the piston rod to the other of said arms.

3. An apparatus as set forth in claim 1, wherein said means for moving vertically the upper and lower expansion spatulas toward or away from each other is constituted by a tube rotatably supported on the movable base plate and having at the forward end the lower expansion spatula secured thereto, a shaft rotatably fitted in the tube and having at the forward end the upper expansion spatula secured thereto and extending from both ends of the tube, and a stationary cam firmly mounted on the movable base plate, said tube and shaft each having at the rear end a lever with a roller, said levers being biased toward each other by means of spring such that said rollers are normally in abutting engagement with the upper and lower surfaces of said stationary cam.

4. An apparatus as set forth in claim 1, wherein said means for transferring the upper and lower keep plates, the upper and lower expansion spatulas and the width setting spatula together in the lengthwise direction of the cloth is constituted by a block for the upper and lower keep plates, a block for the upper and lower expansion spatulas and a block for the width setting spatula, said blocks being aligned movably on the movable base plate in the lengthwise direction of the cloth to be tucked and being connected in spaced relation from one another, and a driving means for transferring said block relative to said movable base plate.

5. An apparatus as set forth in claim 4, wherein said block for the width setting spatula is connected to the adjacent block so as to be movable relative to the same in the lengthwise direction of the cloth to be tucked and is connected to one of the other blocks through a driving means.

6. An apparatus as set forth in claim 1, wherein said means for moving the double tucking plate in the lengthwise direction of the cloth is constituted by a block for the double tucking plate supported and guided on the stationary base plate for movement in the lengthwise direction of the cloth to be tucked, and a driving means for moving said block.

7. An apparatus as set forth in claim 1, wherein a means for raising and lowering said movable base plate is provided.

8. An apparatus as set forth in claim 7, wherein the movable base frame is pivotally connected at one side to the base frame and is supported at the other side by one end of a swing lever pivotally supported at the middle thereof on the base frame, said swing lever being connected at the other end to a driving means for lifting and lowering the movable base plate, whereby said movable base plate can be pivotally moved up and down.

* * * * *